US009181858B2

(12) United States Patent
Muenz et al.

(10) Patent No.: US 9,181,858 B2
(45) Date of Patent: Nov. 10, 2015

(54) TURBOCHARGED ENGINE WITH A SENSOR DEVICE IN THE TURBOCHARGER HOUSING

(71) Applicants: Stefan Muenz, Ludwigshafen (DE); Juergen Ganser, Urbach (DE); Klaus Winkler, Rutesheim (DE); Christopher Holzknecht, Stuttgart (DE); Christoph Peters, Stuttgart (DE); Lothar Diehl, Gerlingen (DE); Sascha Klett, Oppenweiler (DE); Johannes Misselwitz, Leonberg (DE)

(72) Inventors: Stefan Muenz, Ludwigshafen (DE); Juergen Ganser, Urbach (DE); Klaus Winkler, Rutesheim (DE); Christopher Holzknecht, Stuttgart (DE); Christoph Peters, Stuttgart (DE); Lothar Diehl, Gerlingen (DE); Sascha Klett, Oppenweiler (DE); Johannes Misselwitz, Leonberg (DE)

(73) Assignee: ROBERT BOSCH GMBH, Stuttgart (DE)

( * ) Notice: Subject to any disclaimer, the term of this patent is extended or adjusted under 35 U.S.C. 154(b) by 93 days.

(21) Appl. No.: 13/854,652

(22) Filed: Apr. 1, 2013

(65) Prior Publication Data

US 2013/0283786 A1 Oct. 31, 2013

(30) Foreign Application Priority Data

Apr. 2, 2012 (DE) ..... 10 2012 205 364

(51) Int. Cl.

| | |
|---|---|
| ***F02B 33/44*** | (2006.01) |
| ***F02B 37/18*** | (2006.01) |
| ***F01D 9/02*** | (2006.01) |
| ***F01D 21/00*** | (2006.01) |

(52) U.S. Cl.

CPC ..... *F02B 37/18* (2013.01); *F01D 9/026* (2013.01); *F01D 21/003* (2013.01); *F05D 2220/40* (2013.01); *F05D 2270/0831* (2013.01); *F05D 2270/80* (2013.01)

(58) Field of Classification Search

CPC .... F01D 21/003; F02B 37/18; F05D 2270/80
USPC ..... 60/605.1
See application file for complete search history.

(56) References Cited

U.S. PATENT DOCUMENTS

| | | | | |
|---|---|---|---|---|
| 6,348,141 | B1 * | 2/2002 | Kato et al. | 204/428 |
| 7,390,385 | B2 * | 6/2008 | Ikoma et al. | 204/428 |
| 7,434,448 | B2 * | 10/2008 | Weyl et al. | 73/23.31 |
| 7,748,216 | B2 * | 7/2010 | Eiraku et al. | 60/602 |
| 2012/0222418 | A1 * | 9/2012 | Watanabe | 60/602 |
| 2012/0312011 | A1 * | 12/2012 | Romblom | 60/605.1 |
| 2013/0283783 | A1 * | 10/2013 | Sato | 60/603 |
| 2013/0305707 | A1 * | 11/2013 | Takagi | 60/597 |
| 2014/0026562 | A1 * | 1/2014 | Brueck et al. | 60/605.1 |
| 2014/0196704 | A1 * | 7/2014 | Shutty et al. | 123/676 |

FOREIGN PATENT DOCUMENTS

| | | | | |
|---|---|---|---|---|
| DE | 102009046391 | * | 5/2011 | |
| DE | 102010003236 | * | 9/2011 | |
| JP | 01096438 A | * | 4/1989 | F02B 37/12 |
| JP | 2009287409 A | * | 12/2009 | |

* cited by examiner

*Primary Examiner* — Mary A Davis
(74) *Attorney, Agent, or Firm* — Kenyon & Kenyon LLP

(57) ABSTRACT

A turbocharger for use in an internal combustion engine has at least one turbocharger housing, at least one compressor situated inside the turbocharger housing, and at least one turbine situated inside the turbocharger housing. In addition, the turbocharger has at least one sensor device for detecting at least a portion of a gas component of an exhaust gas of the internal combustion engine. The sensor device is at least partially integrated into the turbocharger housing.

11 Claims, 4 Drawing Sheets

TURBOCHARGED ENGINE WITH A SENSOR DEVICE IN THE TURBOCHARGER HOUSING

BACKGROUND OF THE INVENTION

1. Field of the Invention

The present invention relates to a turbocharger for an internal combustion engine.

2. Description of the Related Art

Sensor elements for detecting at least a portion of at least one gas component of a gas, such as an exhaust gas, in a measuring-gas chamber, especially in an exhaust-gas tract, are known from the related art. For example, such sensor elements are described in Robert Bosch GmbH: Sensors in the Motor Vehicle, 1st edition 2010, pages 160-165. The sensor elements may be used in the automotive field, for example. The measuring gas chamber in particular could be the exhaust-gas tract of a combustion engine, for instance, and the sensor element a lambda probe. The core of the sensor element, especially the lambda probe, usually is a technical ceramic, which may be destroyed if, for instance, large mechanical tensions occur in the sensor element. For example, tensions, especially mechanical tensions, could be produced by local cooling of the, in particular, hot technical ceramic, for example, especially a ceramic, due to impinging water drops, for instance. Sensor elements known from the related art are normally situated within the exhaust-gas tract in the exhaust direction, especially in the flow direction of the exhaust gas, downstream from a turbocharger and preferably upstream from a catalytic converter, especially a three-way catalytic converter. Water loading, especially in conjunction with an increasing likelihood of impinging water drops, is usually greatest during a cold engine start. In an engine operation with a cold exhaust-gas tract, e.g., during the cold engine start, exhaust-gas moisture may condense on walls, the exhaust-gas tract, for example, encompassing at least one cylinder outlet, at least one manifold, at least one turbocharger, especially at least one exhaust turbocharger, and at least one three-way catalytic converter. An exhaust gas mass flow can carry exhaust gas condensate along, especially in such a way that a high moisture load of a downstream lambda probe often comes about as a result.

The related art describes various strategies for protecting the sensor element, especially the functional ceramic, from damage, in particular damage resulting from stresses. For example, the technical ceramics may be heated to operating temperature only after a so-called dew point end instant has been reached. In a cold state, especially prior to the dew point end, the mechanical stresses in the sensor element caused by the admission of water are generally non-critical. One particular disadvantage of this strategy is a late operating readiness of the sensor element, especially a probe, following the engine start.

In another strategy, the sensor element may be enclosed by a water-proof protective coat, for example, which is able to distribute local cooling, preferably across a large surface. One particular disadvantage in this case may be a limited absorption capacity of the protective coat with regard to moisture. Another disadvantage may be an increased heating power requirement, especially if large exhaust gas mass flows are involved.

The classic installation position of the sensor element, especially the lambda probe, known from the related art, such as between the turbocharger, especially the exhaust-gas turbocharger, and the three-way catalytic converter, may be disadvantageous from the aspect of space utilization. Another, preferably fixated and/or protected installation position of the sensor element, in particular the lambda probe, is desirable. Other installation positions for sensors, especially sensors in the broadest sense, are known from the related art.

Published German patent application document DE 10 2006 058 539 A1 describes a self-ignition engine having a pressure-based combustion control. For example, this laid-open publication describes that an engine may be equipped with exhaust-gas/fuel-ratio sensors, e.g., in an exhaust-gas manifold.

Published German patent document DE 601 02 337 T2, for example, describes a system for aiding in the regeneration of a particle filter in a self-igniting internal combustion engine. In FIG. 1 of this translation of a European patent publication, a lambda probe is disclosed, which is schematically situated between a Diesel engine and a turbocharger, which is followed by an oxidation catalytic converter.

Published German patent document DE 601 30 851 T2 describes a turbocharger control unit. It is stated that the turbocharger system has one or more sensors.

Published German patent application document 10 2008 034 680 A1 describes a cooled turbocharger housing having one or more electronic devices. In one specific development according to the present invention, it is indicated that the electronic device is a sensor device, for instance.

An orientation of a shield tube with respect to the sensor element, especially to a gas entry hole of the sensor element, is generally variable in the related art, for construction-related reasons. A preferably fixed orientation of sensor element/shield tube is desirable. Reaching the operational readiness of the sensor element, especially the lambda probe, more rapidly following an engine start would be desirable. To do so, the admission of water to the sensor element, especially the lambda probe, after the engine start preferably should be reduced. At the same time, for example, a high dynamic response of the sensor element, especially a high dynamic response of the lambda probe, to a change in the oxygen partial pressure should be ensured. In addition, it would be desirable to ensure a uniform and/or protected installation position and/or installed state of the sensor element, especially the lambda probe, in various space concepts.

BRIEF SUMMARY OF THE INVENTION

Therefore, a turbocharger for use in an internal combustion engine is provided, which specifically avoids, or at least reduces, the disadvantages known from the related art, especially the afore-described disadvantages, of components of an exhaust tract. The internal combustion engine basically may be a device which converts energy from a fuel into mechanical energy by way of combustion processes, e.g., at least one oxidation reaction. The internal combustion engine preferably may be a motor vehicle. The turbocharger has at least one turbocharger housing. The turbocharger housing in particular may be part of a turbocharger, the turbocharger housing preferably being at least partially an outer surface of the turbocharger or including an outer surface of the turbocharger, or a part thereof. Furthermore, the turbocharger includes at least one compressor situated inside the turbocharger housing, and at least one turbine situated inside the turbocharger housing. The compressor in particular may be a device set up to steer air, especially oxygen, into at least one engine of the internal combustion engine, and/or to aspirate air, especially oxygen, from the ambient air, and/or to pump it into the engine. In particular, the compressor may be configured to compress air. The compressor in particular may include at least one, preferably multiple, turbocharger blade(s), which could be disposed in such a way that a rotor is formed. The rotor may be connected to the turbine, in particular via a shaft, especially via an axle, preferably in such a way that a rotation of the turbine is transmitted to the compressor, in particular the rotor of the compressor, such that the rotor rotates and air is able to be aspirated from the environment and/or pumped into the engine and/or compressed. Preferably, the turbine may be a system of at least one turbocharger blade, such that the system forms a rotor. The turbine in particular may be configured to be set into rotation by an inflow of exhaust gas, for example in order to operate the compressor, preferably via the axle. In addition, the turbocharger includes at least one sensor device for acquiring at least a portion of a gas component of an exhaust gas of the internal combustion engine.

The sensor device, especially a lambda probe, is at least partially integrated into the turbocharger housing. "Integrated" in particular may be understood to mean that the sensor device is at least partially connected to the turbocharger housing, directly or indirectly. For example, "integrated" may also mean that the sensor device is at least partially situated inside the turbocharger housing.

The sensor device may at least partially be disposed inside a volute of the turbine. The volute preferably could be an exhaust-gas supply line to the turbine, which is designed to resemble a spiral. For example, the volute may be an exhaust-gas supply line to the turbine, the supply line at least partially having a spiral-shaped design. A cross-section, especially a diameter, of the supply line and/or the extension of the volute may taper in the flow direction, in particular.

The turbocharger may include at least one wastegate access. The wastegate access in particular may be a device for controlling the exhaust-gas flow, e.g., the exhaust-gas mass flow, through the turbocharger, especially through the volute and/or the turbine. Without wastegate access, the turbine would usually rotate very fast, e.g., in an operation of the internal combustion engine at full throttle. The rapid rotation in particular would cause much air to be compressed, so that the engine preferably would become more and more powerful. A wastegate access in particular may be set up to short-circuit an exhaust-gas supply line to the turbocharger, with an exhaust-gas discharge, especially out of the turbocharger. The wastegate access in particular may be situated between the manifold and the turbocharger, especially in an exhaust-gas system. Preferably, the wastegate access may include a flap valve, and an angle of the flap valve is able to be opened and/or closed in such a way that the inflow of exhaust gas to the turbocharger, especially the exhaust gas mass flow, is controllable. The sensor device may be at least partially positioned behind, especially behind in the flow direction of the exhaust gas, the wastegate access, preferably in an exhaust gas supply line to the turbine. For example, the sensor device may at least partially be situated between the wastegate access and the turbocharger and/or the volute, and/or the turbine, and/or the exhaust-gas outlet of the turbocharger.

For example, the sensor device is connectable to the turbocharger housing in reversible manner. A "reversible connection" may be understood to mean that the sensor device is able to be uninstalled, especially in such a way that the sensor device and/or the turbocharger housing and/or another part of the turbocharger will not be damaged and/or damaged in such a way that the damage is able to be repaired without particular expense. In particular, a separate exchange of the sensor device and/or the turbocharger housing is possible in the case of a reversible connection.

For example, the sensor device is able to be screwed to the turbocharger housing. The sensor device in particular may be screw-fitted to the turbocharger housing using at least one cap screw and/or at least one screw cap. Screw-fitting in this case may describe an affixation by means of at least one screw and/or at least one nut, in particular.

For instance, the screw coupling may include at least one further part, e.g., at least one washer and/or at least one seal.

In principle, the sensor device is also able to be joined to the turbocharger housing and/or another component of the turbocharger by some other connection technique, e.g., by welding and/or bonding and/or press-fitting and/or riveting and/or nailing and/or soldering and/or by direct screw-fitting of the turbocharger housing with the sensor device, using at least one thread on the turbocharger housing and/or the sensor device, for example. The cap screw and/or the screw cap, for instance, may be a screw provided with at least one cavity, especially a centered tubular opening, and/or at least one thread, preferably on the outside and/or inside, such as at least one internal thread and/or at least one external thread. A screw joint in particular may describe an affixation in which at least one part of the sensor device and/or at least one section of the turbocharger housing and/or the cap screw and/or the screw cap execute(s) at least one rotation and/or at least one torsion during the assembly.

The sensor device may include at least one sensor element. For example, the sensor device and/or the sensor element could be a lambda probe, especially as described in Robert Bosch GmbH: Sensors in the Motor Vehicle, 1st edition 2010, pages 160-165. The turbocharger according to the present invention in particular may include at least one sensor element, preferably at least one lambda probe, in a protected installation position. For example, the sensor element can have at least two electrodes and at least one solid electrolyte connecting the electrodes, such as a technical ceramic. A first electrode, which may be acted on by the exhaust gas and/or by some other gas, and at least one second electrode may be included in the sensor element. The sensor element may be a lambda probe, in particular, e.g., a lambda probe having one cell and/or a lambda probe having two cells. The sensor element preferably could be a broadband lambda probe. The first electrode and the second electrode are able to be connected via the at least one solid electrolyte. The solid electrolyte in particular may be a ceramic solid electrolyte, e.g., zirconia dioxide, especially yttrium-stabilized zirconia dioxide (YSZ) and/or scandium-doped zirconia dioxide (ScSZ). The first electrode preferably is an outer pumping electrode. The second electrode preferably may be an inner pumping electrode, for instance. The terms "first" and "second" in this case are expressions which contain no information about a particular sequence. For example, further electrodes, such as at least one third electrode, e.g., at least one reference electrode, may be included in the sensor element. An electrode, for instance the first electrode and/or the second electrode and/or the third electrode, in particular may be a component to which an electrical voltage and/or an electrical current is able to be applied. The sensor element, especially the lambda probe, preferably is able to generate at least one sensor signal, e.g., an electrical pumping current and/or a Nernst voltage. For example, using a characteristics curve, the proportion, especially an oxygen concentration, in the exhaust gas is inferable from the sensor signal, preferably if the overall pressure is known. The component is able to be recorded directly or indirectly, for example. For instance, it is possible to detect an oxygen partial pressure in direct manner and to use it, for instance in conjunction with an overall pressure, to ascertain the oxygen component and/or an oxygen percentage. The gas component preferably may be oxygen, especially molecular oxygen. The component in particular may be a percentage and/or a partial pressure. The exhaust gas in particular may be a mixture, especially a gas mixture, e.g., of air and/or combustion gases, such as from the engine of the internal combustion engine.

The sensor device optionally may include at least one shield tube. The shield tube preferably could be at least one guide vane mechanism. The shield tube and/or the guide vane mechanism generally may be a housing of the sensor device. The sensor element may at least partially be disposed inside the shield tube. For instance, it is also possible for the sensor element to be completely disposed inside the shield tube, it particularly being possible for the sensor element to be surrounded by the shield tube either completely or partially.

In a preferred manner, the shield tube may be developed to guide condensate past the sensor element. In principle, the condensate may be a fluid, preferably a liquid, especially water, the fluid possibly being condensed from the exhaust gas due to cooling, for example. To "guide past" in this case means that the condensate passes the sensor device without making contact with the sensor element, especially the first electrode and/or the second electrode and/or the third electrode and/or the solid electrolyte. The shield tube preferably is able to be connected to the turbocharger housing and/or the sensor element in reversible manner. For example, a "reversible connection" may be understood to mean that the shield tube and/or the turbocharger housing and/or sensor element are/is able to be uninstalled, especially in such a way that the shield tube and/or the turbocharger housing and/or the sensor element and/or some other part of the turbocharger will not be damaged and/or damaged only to such an extent that the damage is able to be repaired quite easily. A reversible connection in particular may allow an individual exchange of the shield tube and/or the turbocharger housing and/or the sensor element.

The shield tube in particular may be reversibly connected and/or fixed in place in flush manner, e.g., flush with the wall, e.g., on a rear volute wall inside the turbocharger, especially using a cap screw and/or screw cap.

The shield tube may include at least one inlet opening and/or at least one outlet opening. The inlet opening preferably may be an opening for routing the exhaust gas into the shield tube, preferably toward the sensor element. The outlet opening preferably may be an opening for discharging the exhaust gas from the shield tube. The inlet opening and/or the outlet opening, for example, may be holes and/or round and/or oval and/or rectangular and/or square and/or slotted openings. The openings may basically also have other forms. Preferably, the inlet opening may be separate from the outlet opening. The inlet opening and the outlet opening may basically overlap at least partially or be identical. The inlet opening preferably may be situated closer to a wall, e.g., an outer wall, of the volute than the outlet opening. Preferably, the inlet opening may be situated in a region of the exhaust-gas flow that has a lower flow velocity, e.g., a lower exhaust-gas flow velocity, than the flow velocity of the exhaust gas at the outlet opening. Preferably, the inlet opening may be situated at a radial distance $r_{ein}$ from a center point of the turbine. A radial distance in particular may be a distance between the center point of the turbine, e.g., a point on the axle and/or the shaft, and a point in a plane parallel to a rotation plane of the turbine that preferably also includes the center point. The discharge opening preferably may be situated at a radial distance $r_{aus}$ from the center point of the turbine. $r_{ein}$ preferably may be greater than $r_{aus}$. Since a lower pressure usually prevails at $r_{aus}$ than at $r_{ein}$, the exhaust gas may be driven through the shield tube, in particular past the sensor element, by a chimney effect.

The inflow opening and the discharge opening, for instance, may be situated on the same side or on opposite sides of the shield tube. A projection of the inlet opening together with a projection of the outlet opening, onto a plane perpendicular to a longitudinal axis of the shield tube, forms an angle with respect to the intersection of the longitudinal axis with the plane; given a placement on opposite sides, the angle amounts to between 150° and 110°, in particular between 170° and 190°, especially preferably, approximately 180°. If the inflow opening and the discharge opening are on the same side, for example, the angle is between −30° and +30°, in particular between −10° and +10°, especially preferably, approximately 0°.

The inflow opening and the discharge opening may be interconnected, for instance via a bypass. If the inflow opening and the discharge opening are connected to each other via a bypass, the inflow opening and the discharge opening preferably are situated on the same side, e.g., on a side of the shield tube that is directly exposed to the flow of the exhaust gas. If the shield tube does not have a bypass, it may be preferred to place the inflow opening on the side on which the exhaust gas flow arrives, and the discharge opening on the opposite side, for example. The bypass basically may be a connection that carries the exhaust gas between the inflow opening and the discharge opening. For example, the connection may be developed as pipe, such as a bent pipe. Preferably, the bypass may guide the exhaust gas from the inflow opening to the discharge opening via at least a portion of the sensor element, for instance in order to have the exhaust gas act on the first electrode and/or the second electrode.

The turbocharger according to the present invention may have numerous advantages over known turbochargers. Since the turbocharger includes the sensor device, the portion of the gas component of the exhaust gas, e.g., an exhaust gas value, is able to be measured directly and/or more rapidly and/or on a continuous basis. For example, according to SULEV (Super Ultra Low Emission Vehicle) requirements, acquisitions and/or measurements of exhaust-gas values should start immediately after an engine is started up, since 80% of emissions are generally released during that process. This SULEV requirement, for instance, is able to be satisfied when using the turbocharger according to the present invention. For instance, compliance with the SULEV standard makes it possible to reduce emissions. The size of the catalytic converter, and thus the system cost, is able to be reduced if the sensor device, especially the lambda probe, is at least partially integrated into the turbocharger housing, for instance through a direct connection of a catalytic converter to the exhaust-gas turbocharger. For example, the partial pressure and a temperature are able to be measured in an at least approximately continuous manner. Additional shield tubes or welding seams, for example, may be dispensed with in the present invention, which is why temperature stability and/or a high dynamic response are/is able to be ensured, for instance because the bypass may assume the tasks of a second shield tube, in particular. Furthermore, a lower heating voltage requirement (UH) and/or greater thermoshock robustness are/is able to be provided by the present invention. In addition, a uniform placement of the sensor element, especially the lambda probe, is possible, for instance for various applications by users and/or manufacturers.

DETAILED DESCRIPTION OF THE INVENTION

Figure 1A:
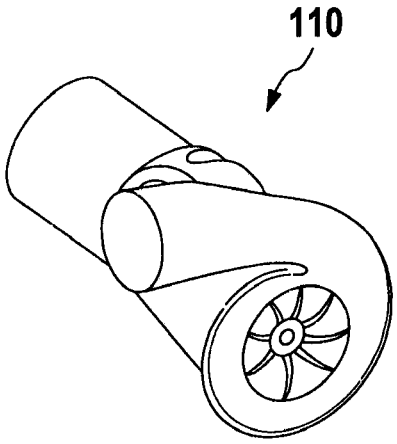
FIG. 1A shows a perspective view of an exemplary embodiment of a turbocharger according to the present invention.
Figure 1B:
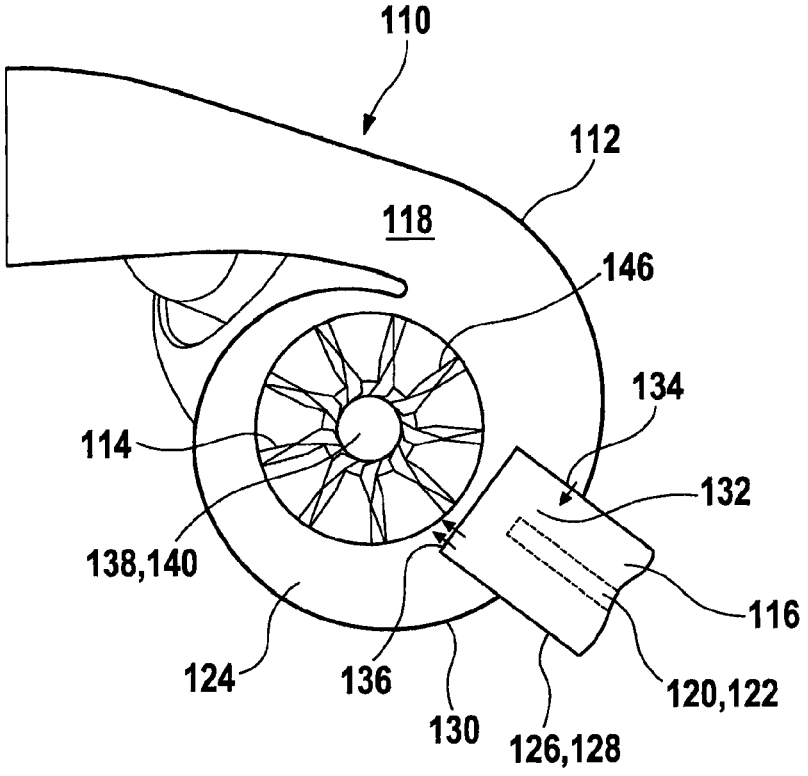
FIG. 1B shows a cross-sectional drawing of the exemplary embodiment of the turbocharger of the present invention according to FIG. 1A.
Figure 2:
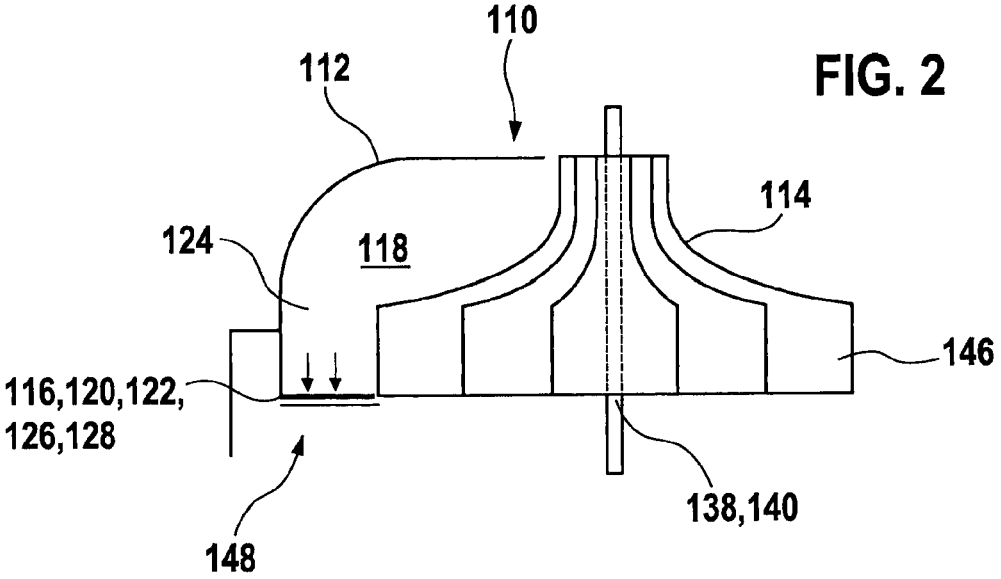
FIG. 2 shows a cross-sectional drawing of another exemplary embodiment of a turbocharger according to the present invention.

FIG. 1A, FIG. 1B and FIG. 2 illustrate exemplary embodiments of a turbocharger 110 according to the present invention. Turbocharger 110 is a turbocharger 110 for use in an internal combustion engine. Preferably, turbocharger 110 may be an exhaust-gas turbocharger. Turbocharger 110 has at least one turbocharger housing 112. Furthermore, turbocharger 110 includes at least one compressor situated inside turbocharger housing 112, and at least one turbine 114 situated inside turbocharger housing 112. In addition, turbocharger 110 has at least one sensor device 116 for recording at least a portion of a gas component of an exhaust gas 118 of the internal combustion engine. Sensor device 116 is at least partially integrated into turbocharger housing 112. Sensor device 116 may include at least one sensor element 120. In particular, sensor element 120 may be a lambda probe 122; in general, sensor element 120 may be a probe. For example, sensor element 120 and/or lambda probe 122 may be a lambda probe 122 known from the related art, especially a lambda probe 122 which in the related art is able to be placed in an exhaust-gas tract, preferably upstream from a three-way catalytic converter. Sensor device 116, in particular sensor element 120, preferably lambda probe 122, is able to be positioned in close proximity to the engine, e.g., at an installation position between a manifold, which, for instance, may be situated directly behind the engine in the exhaust-gas flow direction, and turbocharger 110. According to the present invention, sensor device 116 is at least partially integrated into turbocharger housing 112 of turbocharger 110. One specific advantage of positioning it near the engine, for instance at least partially integrated into turbocharger housing 112, may be that, due to hot exhaust gases 118 from the cylinders of the engine at such an installation position, a dew point end is typically able to be reached faster than, for example, in the back in the exhaust track, e.g., downstream from turbocharger 110 in the direction of the exhaust-gas flow.

Turbocharger 110 may include at least one wastegate access, which is not shown in FIG. 1A, FIG. 1B and FIG. 2. It is possible for sensor device 116 to be at least partially situated behind the wastegate access. The term "behind" in particular may indicate a position at a location that lies farther away in the flow direction of exhaust gas 118.

Sensor device 116 preferably may at least partially be disposed in a volute 124 of turbine 114. In particular, sensor device 116, preferably lambda probe 122, may be situated behind the wastegate access in volute 124 of turbine 114 of turbocharger 110, e.g., the exhaust-gas turbocharger. The wastegate access may be an exhaust-gas line, in particular, which short-circuits a supply line, especially a supply line of exhaust gas 118, to turbocharger 110 with a discharge line, especially a discharge line of exhaust gas 118. For example, an open wastegate, especially a wastegate access, is able to discharge water from volute 124 already following an engine start, during cat-heating, especially the heating of the catalytic converter. This makes it possible, for example, to achieve lower water loading of sensor device 116 and/or sensor element 120 and/or lambda probe 122. In particular the installation location according to the present invention, especially behind the wastegate access in volute 124 of turbine 114 of turbocharger 110, offers a protected and/or fixed installation position of sensor device 116 and/or sensor element 120 and/or lambda probe 122. For example, the proposed installation location, especially the installation location behind the wastegate access in volute 124 of turbine 114 of turbocharger 110, may allow a more efficient utilization of the engine space. Turbocharger 110 according to the present invention in particular may represent an exhaust-gas turbocharger having an already integrated lambda probe 122.

Preferably, sensor device 116 is able to be connected to turbocharger housing 112 in reversible manner. The expression "connectable in reversible manner" in particular means that sensor device 116 and/or sensor element 120 and/or lambda probe 122 and/or parts of turbocharger 110 are/is able to be exchanged separately, for example, without causing extensive damage to sensor device 116 and/or to sensor element 120 and/or to lambda probe 122 and/or turbocharger housing 112 and/or to other parts of turbocharger 110.

Sensor device 116 in particular is able to be screw-fitted with turbocharger housing 112. Sensor device 116 and/or sensor element 120 and/or lambda probe 122 may be screw-fitted with turbocharger housing 112 using at least one cap screw and/or at least one screw cap, in particular. For example, lambda probe 122 is able to be fixed in place on turbocharger housing 112 by means of at least one cap screw. This provides an in particular directed installation of sensor device 116, especially lambda probe 122, with respect to exhaust gas 118, especially with respect to the exhaust-gas mass flow. Another advantage may be that this makes it possible to increase the dynamic response of a sensor signal, especially a signal from sensor device 116, for instance during a switch, especially a change, of a partial pressure, e.g., an oxygen partial pressure, in exhaust gas 118. Because of the fixation of sensor device 116 and/or sensor element 120 and/or lambda probe 122, especially because of the reversible fixation, e.g., using at least one cap screw and/or at least one screw cap, sensor device 116, especially lambda probe 122, is exchangeable, such as in the event of damage. For example, sensor device 116 and/or sensor element 120 and/or lambda probe 122 may be press-fitted with a subassembly, especially with at least a section of turbocharger 110, using at least one cap screw and/or at least one screw cap, so that, for example, a temperature-sensitive welding seam of the probe, especially of sensor device 116, is able to be dispensed with. Basically it is possible to mount sensor device 116 on turbocharger housing 112 and/or turbocharger 110 in some other manner as well, e.g., by at least one welding seam.

Using a fixation that employs at least one cap screw and/or at least one screw cap or which uses a press-fit connection, sensor device 116, such as a probe, may be able to withstand high temperatures.

Sensor element 120 may include at least one first electrode which is acted upon by exhaust gas 118, and at least one second electrode, and the first electrode and the second electrode are able to be connected via at least one solid electrolyte. Sensor element 120 in particular may be a sensor element 120, which, for instance, is described in Robert Bosch GmbH: Sensors in the Motor Vehicle, $1^{st}$ edition 2010, pages 160-165.

FIG. 1A and FIG. 1B show an exemplary embodiment of turbocharger 110 according to the present invention; a view essentially in the direction of an axle 140 of turbine 114 of turbocharger 110 is shown, in particular. Axle 140 preferably is situated perpendicularly to a rotation plane of turbine 114. Exhaust gas 118 flows through volute 124, preferably in clockwise manner, as shown in FIG. 1B in particular, e.g., in a spiral-shaped motion.

FIG. 2 illustrates another exemplary embodiment of turbocharger 110 according to the present invention, the figure showing a cross-section parallel to axle 140 of turbocharger 110, especially along axle 140 of turbocharger 110, in particular.

Sensor device 116 may include at least one shield tube 126, e.g., at least one guide vane mechanism 128. It is possible for sensor element 120 to be at least partially situated inside shield tube 126. Lambda probe 122, especially together with shield tube 126, is able to be placed inside turbocharger housing 112, in particular inside a housing of turbocharger 110. Shield tube 126 may at least partially be developed in cylindrical shape and/or in block shape, for example, but basically may also have some other form. FIGS. 1B and 2, for instance, illustrate one location of shield tube 126, especially of guide vane mechanism 128, guide vane mechanism 128 being able to be positioned in volute 124 of turbine 114, in particular. FIG. 2, in particular, shows a cross-section of turbine 114, especially an exhaust-gas turbocharger turbine, especially of turbine 114 of turbocharger 110.

Shield tube 126, in particular guide vane mechanism 128, is able to be designed to route condensate past sensor element 120 and/or past sensor device 116 and/or past lambda probe 122, preferably without the condensate coming into contact with sensor element 120 and/or lambda probe 122, especially thermal contact. The condensate, for instance, may be a fluid, in particular, preferably a liquid, especially water. Preferably, shield tube 126 may be designed in such a way that water is able to be routed past sensor element 120. This specifically reduces the risk of water acting on sensor element 120, especially lambda probe 122, and preferably avoids damage to sensor device 116 and/or sensor element 120 and/or lambda probe 122. For instance, shield tube 126, especially guide vane mechanism 128, may be developed in such a way that fluid, e.g, a liquid, especially water, is able to be separated out in advance, in particular a separation of the fluid from exhaust gas 118. This achieves increased thermal shock robustness, for instance because of shield tube 126, especially guide vane mechanism 128.

Shield tube 126, in particular guide vane mechanism 128, preferably is able to be connected to turbocharger housing 112 in reversible manner. Sensor device 116, especially shield tube 126, e.g., guide vane mechanism 128, preferably may be implemented to be virtually flush with the wall, e.g., rear volute wall 130, inside turbocharger 110, as shown in FIG. 1B, for example; rear volute wall 130 may be disposed roughly opposite an exhaust gas supply line of volute 124, for example, but sensor device 116 may also be implemented at a different part of volute 124. Shield tube 126, especially vane guide mechanism 128, may be mounted on turbocharger housing 112, especially on rear volute wall 130, in particular by means of at least one cap screw and/or at least one screw cap. For instance, shield tube 126 and/or sensor device 116 may be installed in flat manner, especially in such a way that a flow of exhaust gas 118 and/or an air flow encounter(s) as little interference as possible. Using a guide vane mechanism 128, a selective flow of exhaust gas 118, for instance, may be directed toward sensor element 120, e.g., lambda probe 122. Through an installation, e.g., of shield tube 126 and/or the positioning of sensor device 116, an insulating effect of a gap 132, which, for instance, may exist between sensor element 120 and turbocharger housing 112 and/or shield tube 126, e.g., in the form of a gas gap and/or air gap, thermal isolation of sensor device 116 and/or sensor element 120 and/or lambda probe 122 or a probe, from a screw-in connecting piece, e.g., the cap screw and/or the screw cap, and/or at least one part of turbocharger housing 112 may be provided. The thermal isolation may reduce the thermal loading of sensor device 116, in particular, e.g., the probe and/or sensor element 120 and/or lambda probe 122. For example, shield tube 126 and/or guide vane mechanism 128 and/or sensor device 116 and/or sensor element 120 and/or lambda probe 122 may be fixed in place by being pressed into turbocharger housing 112, e.g., in a sealing seat. This makes it possible to develop a joint, especially gap 132, preferably a region between shield tube 126, in particular guide vane mechanism 128, and sensor element 120, especially lambda probe 122 and/or the probe, in protected and/or robust manner.

Figure 4:
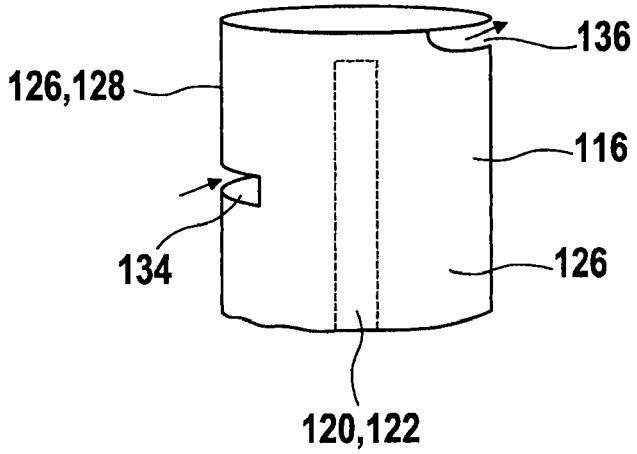
FIG. 4 shows an illustration of an optional development of a sensor device, as it may be provided in an exemplary embodiment of a turbocharger according to the present invention.
Figure 5:
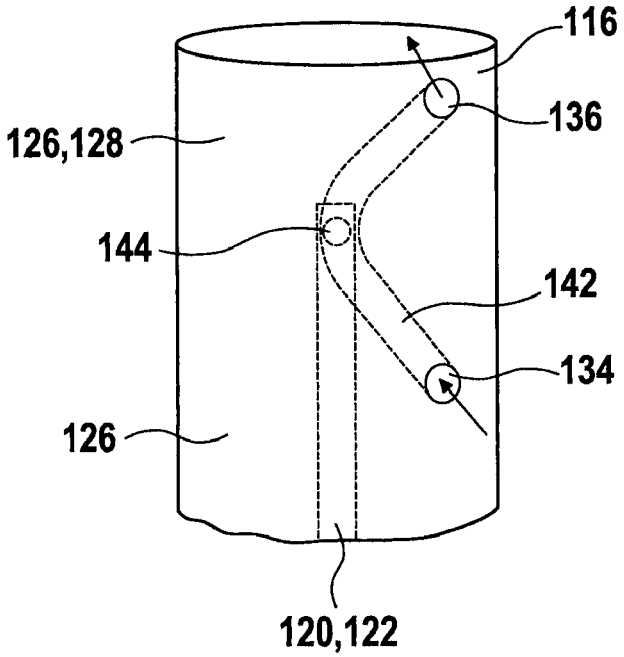
FIG. 5 shows another illustration of an optional development of a sensor device, as it may be provided in an exemplary embodiment of a turbocharger according to the present invention.

Shield tube 126 may include at least one inflow opening 134 and/or at least one discharge opening 136. Shield tubes 126, especially guide vane mechanisms 128 are shown in FIGS. 4, 5 and 1B by way of example. Inflow opening 134 and/or discharge opening 136, for example, may be developed as holes, such as round holes and/or elongated holes. In FIG. 4, inflow opening 134 is developed as elongated hole, for example, preferably as slot having a rectangular projection surface on an axial plane of shield tube 126. Discharge opening 136 is likewise developed as elongated hole in FIG. 4, especially as elongated hole without corners. It is basically also possible that inflow opening 134 and discharge opening 136 have the same geometry. Both FIG. 4 and FIG. 5 illustrate possible developments of shield tubes 126 which are at least partially implemented in the form of a cylinder. One shield tube 126, which is shown in FIG. 5, for instance, preferably may include a round inflow opening 134 and a round discharge opening 136. Inflow opening 134 may be situated at a radial distance $r_{ein}$ from a center point of turbine 138. The center point of turbine 138 may be situated on axle 140 of turbine 114, in particular. Discharge opening 136 preferably may be situated at a radial distance $r_{aus}$ from the center point of turbine 138. $R_{ein}$ preferably is greater than $r_{aus}$. For example, sensor device 116 and/or rear volute wall 130 are/is able to be placed at a radial distance R from the center point of turbine 138. A tip of a turbocharger blade 146, for example, may have a radial clearance $R_{LR}$ with respect to the center point of turbine 138.

In the exemplary embodiment shown in FIG. 1B, in particular, inflow opening 134, marked by an arrow which indicates the flow direction of the incoming exhaust gas 118, lies at a greater distance from the center point of turbine 138 than discharge opening 136, two arrows marking the direction of outflowing exhaust gas 118. The fact that discharge opening 136 preferably is situated closer to the center point of turbine 138 than inflow opening 134 is also shown in FIGS. 4 and 5, in that discharge openings 136 lie closer to a sealed end of shield tube 126, especially guide vane mechanism 128, than inflow openings 134, the sealed end of shield tube 126 generally representing the part of shield tube 162 that faces away from the mounting position of sensor device 116 on turbocharger housing 112, e.g., the cap screw and/or the screw cap. The open side of shield tube 126, especially guide vane mechanism 128, in particular the side on the mounting position, may likewise be sealed, and preferably include openings, such as for the feedthrough of cables.

Figure 3A:
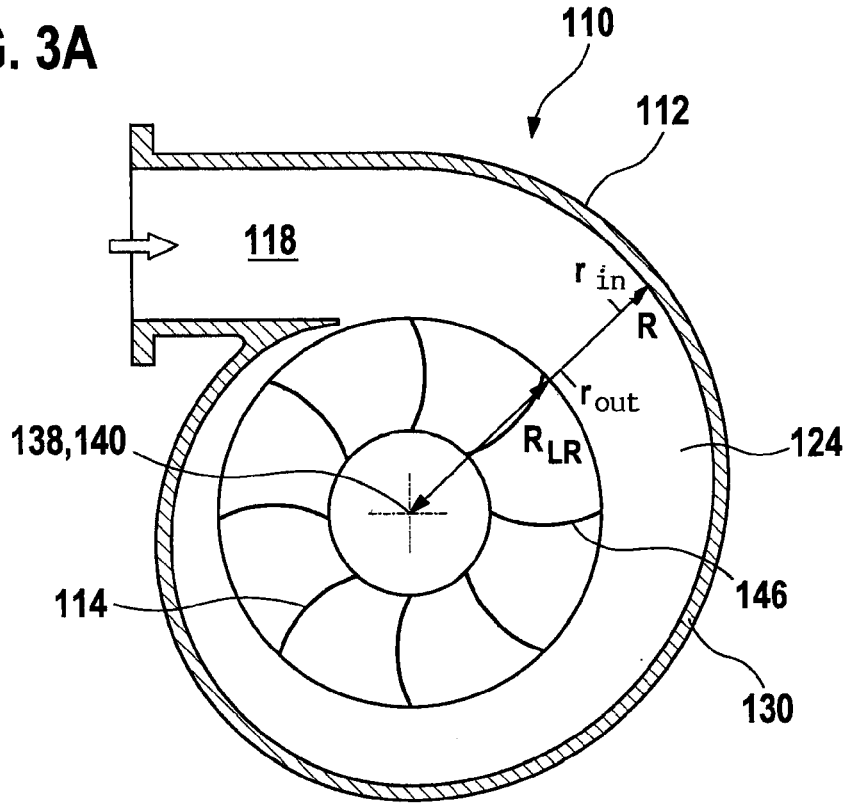
FIG. 3A shows a schematic representation of a turbocharger according to the present invention, to clarify the pressure distribution.
Figure 3B:
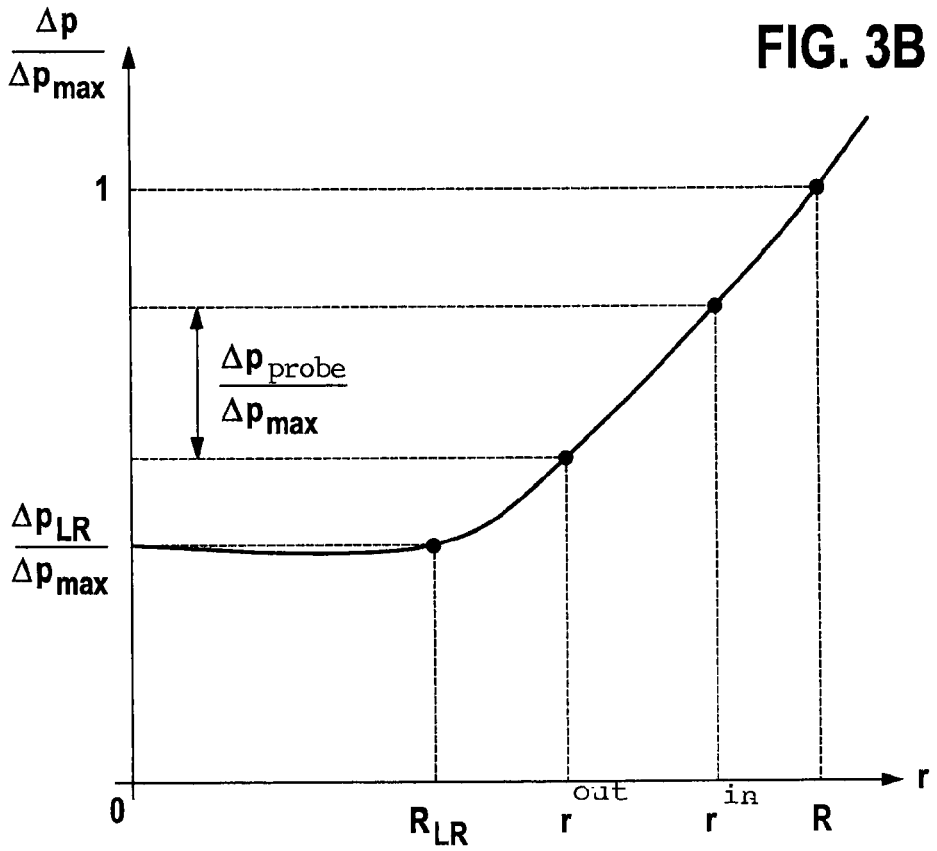
FIG. 3B shows an illustration of the pressure distribution in a volute of a turbocharger according to the present invention.

FIGS. 3A and 3B show a stable pressure distribution and/or a pressure gradient, as it preferably may occur in an exemplary embodiment of a turbocharger 110 according to the present invention, especially in volute 124 of turbocharger 110. FIG. 3A, in particular, illustrates radial distances $R_{LR}$ and R of a turbocharger 110, which is shown here without sensor device 116. In FIG. 3B, in particular the ratio of a pressure Δp in relation to a maximum pressure $\Delta p_{max}$ has been plotted by way of example over a distance r, for instance over the radial distance, especially over a radius, r preferably being measurable starting from the center point of turbine 138. In particular a relative pressure $$\frac{\Delta p}{\Delta p_{max}}$$

for the radial distances $R_{LR}$, $r_{aus}$ and $r_{ein}$, R, as shown in FIG. 3A, is plotted. The pressure distribution and/or the pressure gradient in particular may be due to the principle of the axial blower, especially turbine 114. The stable pressure gradient and/or the stable pressure distribution as it preferably exists in turbocharger 110 according to the present invention, as shown in FIGS. 1A, 1B, 2 and 3A by way of example, may essentially be used as the driving force for a through-flow, in particular, of sensor element 120 and/or shield tube 126 and/or guide vane mechanism 128, especially a flow approaching sensor element 120 and/or lambda probe 122, preferably of exhaust gas 118. Inflow opening 134 of shield tube 126, preferably of guide vane mechanism 128, preferably is situated on radius $r_{ein}$, and discharge opening 136 on radius $r_{aus}$, thereby in particular ensuring that a driving pressure gradient and/or a driving pressure distribution exists in all operating points, especially during the entire operation of turbocharger 110 and/or the internal combustion engine, especially from inflow opening 134 to discharge opening 136. A driving pressure gradient and/or a driving pressure distribution in particular may mean a pressure distribution and/or a pressure gradient at which the pressure essentially decreases from inflow opening 134 to discharge opening 136, preferably in a continuous manner, since the pressure at $r_{aus}$ is generally lower than at $r_{ein}$, in particular due to a higher flow velocity of exhaust gas 118 at $r_{aus}$ in comparison to $r_{ein}$, for example, especially since $r_{aus}$ preferably may be situated farther away from a wall, especially the volute wall, e.g., rear volute wall 130, in comparison with $r_{ein}$.

In FIG. 3B, a principle of the pressure distribution and/or the pressure gradient, especially inside volute 124 of turbocharger 110, is illustrated by way of example. The relative pressure $$\frac{\Delta p}{\Delta p_{max}}$$

increases from a distance $R_{LR}$, especially at a tip of a turbocharger blade 146, across $r_{aus}$ and $r_{ein}$ to R, especially at an outer volute wall and/or at a rear volute wall 130, usually in an essentially continuous manner. The pressure difference between the position of inflow opening 134 and discharge opening 136

$$\frac{\Delta p_{Sonde}}{\Delta p_{max}}$$

in particular is able to be read out. Since the pressure at the position of inflow opening 134 $r_{ein}$ preferably is greater than at the position of discharge opening 136 $r_{aus}$, especially as optionally shown in FIG. 3B, a driving force generally comes about which is able to guide exhaust gas 118 from inflow opening 134 to discharge opening 136, for instance in a suction-like manner. Distances $R_{LR}$ and R, which may relate to the diagram from FIG. 3B, are shown in FIG. 3A, for example. The arrow at an entry to volute 124 in FIG. 3A in particular indicates the direction of the exhaust-gas mass flow. A pressure gradient preferably may form between the intake and outlet of exhaust gas 118, especially between inflow opening 134 and discharge opening 136, and the pressure gradient may cause a mass flow, especially an exhaust-gas mass flow, through shield tube 126, especially through guide vane mechanism 128.

For instance, inflow opening 134 and discharge opening 136 may be situated on the same side of shield pipe 126, as shown in FIG. 5, for example. It is also possible for inflow opening 134 and discharge opening 136 to be situated on opposite sides of shield tube 126, as shown in FIG. 4, for example. Inflow opening 134 and discharge opening 136 may also be situated on different sides. Preferably, inflow opening 134 may be disposed on a side of shield tube 126, especially on a shell of shield tube 126, that is exposed to the exhaust-gas flow, and discharge opening 136 preferably may be situated on a side of shield tube 126, in particular a shell of shield tube 126, that lies across from the side exposed to the exhaust-gas mass flow.

Inflow opening and discharge opening 136 may be connected to each other, for instance via at least one bypass 142, preferably via a single bypass 142. If a bypass 142 is provided, as shown in FIG. 5, for example, inflow opening 134 preferably may be situated on the same side as discharge opening 136. The arrows in particular indicate the flow direction of the exhaust-gas mass flow. Bypass 142, for example, may be developed as exhaust-gas line, especially as pipe, e.g., as bent pipe. Bypass 142 in particular may have a wall opening 144, in order to have exhaust gas 118 act on sensor element 120, especially lambda probe 122. Optionally, bypass 142 may be disposed on shield tube 126, in particular on guide vane mechanism 128, especially between the intake and outlet, e.g., between inflow opening 134 and discharge opening 136. For example, bypass 142 may be designed to realize a high flow velocity at a small exhaust-gas mass flow. This makes it possible to achieve a high dynamic response of sensor element 120, for example, especially the sensor signal, and/or to prevent cooling of sensor element 120, e.g., lambda probe 122, especially at the same time.

Turbine 114, for instance, may include at least one turbocharger blade 146. In addition, turbocharger 110 according to the present invention may have at least one pressure bore 148, as shown in FIG. 2. The installation position of sensor device 116, especially sensor element 120, especially preferably, lambda probe 122, may constitute a protected installation position, in particular. Inflow opening 134 may be developed as intake, in particular, and discharge opening 136 may be developed as outlet. Sensor element 120, especially the lambda probe, as illustrated in FIGS. 1B, 4 and 5, may be disposed in shield tube 126 in centered manner, in particular. It is basically also possible to install sensor element 120 in laterally shifted or rotated manner. Shield tube 126, especially sensor element 120, may be positioned perpendicularly to a wall of turbocharger housing 112, especially in relation to rear volute wall 130. "Perpendicular" in this context in particular may mean an angle between 70° and 110°, preferably between 80° and 100°, especially preferably of approximately 90°. In principle, shield tube 126 may also be disposed at another angle relative to a wall of turbocharger housing 112, especially with respect to an axis of symmetry of shield tube 126. Basically, sensor device 116 is able to be positioned at any location of turbocharger 110, preferably in such a way that sensor element 120 is able to be acted upon by exhaust gas 118.

What is claimed is:

1. A turbocharger in an internal combustion engine, comprising:

at least one turbocharger housing;

at least one compressor situated inside the at least one turbocharger housing;

at least one turbine disposed inside the at least one turbocharger housing; and at least one sensor device for detecting at least one portion of a gas component of an exhaust gas of the internal combustion engine, wherein the at least one sensor device is at least partially integrated into the at least one turbocharger housing, and wherein the at least one sensor device is at least partially situated inside a volute of the turbine.

2. The turbocharger as recited in claim 1, wherein the at least one sensor device is connected to the at least one turbocharger housing in a reversible manner.

3. The turbocharger as recited in claim 2, wherein the at least one sensor device is screw-fitted with the at least one turbocharger housing by at least one of a cap screw and a screw cap.

4. The turbocharger as recited in claim 1, wherein:

the at least one sensor device includes at least one sensor element configured as a lambda probe having a first electrode and a second electrode;

the first electrode is configured to be acted upon by the exhaust gas; and the first electrode and the second electrode are connected via at least one solid electrolyte.

5. The turbocharger as recited in claim 4, wherein the at least one sensor device includes at least one shield tube, and the at least one sensor element is at least partially situated inside the at least one shield tube.

6. The turbocharger as recited in claim 5, wherein the at least one shield tube is configured to route a condensate past the at least one sensor element.

7. The turbocharger as recited in claim 6, wherein the at least one shield tube is connected to the at least one turbocharger housing in a reversible manner.

8. The turbocharger as recited in claim 6, wherein the at least one shield tube includes at least one of an one inflow opening and a discharge opening, the at least one inflow opening being at a selected first radial distance from a center point of the at least one turbine, and the discharge opening being situated at a selected second radial distance from the center point of the at least one turbine, the first radial distance being greater than the second radial distance.

9. The turbocharger as recited in claim 8, wherein the at least one inflow opening and the discharge opening are situated on a same side of the shield tube.

10. The turbocharger as recited in claim 8, wherein the at least one inflow opening and the discharge opening are connected to each other via a bypass.

11. The turbocharger as recited in claim 8, wherein the at least one inflow opening and the discharge opening are situated on different sides of the at least one shield tube.

* * * * *